US010950943B2

(12) United States Patent
Chen et al.

(10) Patent No.: US 10,950,943 B2
(45) Date of Patent: Mar. 16, 2021

(54) ANTENNA STRUCTURE

(71) Applicant: Wistron NeWeb Corp., Hsinchu (TW)

(72) Inventors: Chung-Yen Chen, Hsinchu (TW); Chun-Lin Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 16/700,066

(22) Filed: Dec. 2, 2019

(65) Prior Publication Data

US 2020/0411994 A1 Dec. 31, 2020

(30) Foreign Application Priority Data

Jun. 28, 2019 (TW) ..... 108122788

(51) Int. Cl.
*H01Q 9/04* (2006.01)
*H01Q 1/38* (2006.01)
*H01Q 1/24* (2006.01)

(52) U.S. Cl.
CPC ..... *H01Q 9/0435* (2013.01); *H01Q 1/243* (2013.01); *H01Q 1/38* (2013.01)

(58) Field of Classification Search
CPC ..... H01Q 9/0435; H01Q 1/38; H01Q 1/243
See application file for complete search history.

(56) References Cited

U.S. PATENT DOCUMENTS

2012/0249396 A1* 10/2012 Parsche ..... H01Q 21/061 343/866
2018/0034165 A1* 2/2018 Aleksandrovich ..... H01Q 5/392

* cited by examiner

*Primary Examiner* — Daniel D Chang
(74) *Attorney, Agent, or Firm* — McClure, Qualey & Rodack, LLP

(57) ABSTRACT

An antenna structure includes a first feeding element, a second feeding element, a balun structure, a first radiation element, a second radiation element, a third radiation element, a fourth radiation element, a fifth radiation element, a sixth radiation element, and a dielectric substrate. The balun structure includes a central ground element, a first connection element, a second connection element, a third connection element, and a fourth connection element. The first connection element and the third connection element partially surround the central ground element. A first coupling gap is formed between the fifth radiation element and the first radiation element. A second coupling gap is formed between the fifth radiation element and the third radiation element. A third coupling gap is formed between the sixth radiation element and the second radiation element. A fourth coupling gap is formed between the sixth radiation element and the fourth radiation element.

20 Claims, 10 Drawing Sheets

400

700

ANTENNA STRUCTURE

CROSS REFERENCE TO RELATED APPLICATIONS

This application claims priority of Taiwan Patent Application No. 108122788 filed on Jun. 28, 2019, the entirety of which is incorporated by reference herein.

BACKGROUND OF THE INVENTION

Field of the Invention

The disclosure generally relates to an antenna structure, and more particularly, to a small-size, omnidirectional antenna structure.

Description of the Related Art

With the advances being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements for mobile devices in a room to connect to the Internet at a high speed. However, since the indoor environment has serious signal reflection and multipath fading, wireless access points should process signals from a variety of transmission directions simultaneously. Accordingly, it has become a critical challenge for antenna designers to design a small-size, omnidirectional antenna structure in the limited space of a wireless access point.

BRIEF SUMMARY OF THE INVENTION

In an exemplary embodiment, the invention is directed to an antenna structure which includes a first feeding element, a second feeding element, a balun structure, a first radiation element, a second radiation element, a third radiation element, a fourth radiation element, a fifth radiation element, a sixth radiation element, and a dielectric substrate. The first feeding element is coupled to a feeding point. The second feeding element is coupled to the feeding point. The balun structure includes a central ground element, a first connection element, a second connection element, a third connection element, and a fourth connection element. The central ground element has a central opening. The first connection element is coupled to the central ground element. The central ground element is at least partially surrounded by the first connection element. The second connection element is coupled to the central ground element. The third connection element is coupled to the central ground element. The central ground element is at least partially surrounded by the third connection element. The fourth connection element is coupled to the central ground element. The first radiation element is coupled to the first connection element. The first radiation element is fed by the first feeding element. The second radiation element is coupled to the third connection element. The second radiation element is fed by the second feeding element. The third radiation element is disposed adjacent to or coupled to the second connection element. The fourth radiation element is disposed adjacent to or coupled to the fourth connection element. A first coupling gap is formed between the fifth radiation element and the first radiation element. A second coupling gap is formed between the fifth radiation element and the third radiation element. A third coupling gap is formed between the sixth radiation element and the second radiation element. A fourth coupling gap is formed between the sixth radiation element and the fourth radiation element. The dielectric substrate has a top surface and a bottom surface. The first feeding element and the second feeding element are disposed on the top surface of the dielectric substrate. The balun structure, the first radiation element, the second radiation element, the third radiation element, the fourth radiation element, the fifth radiation element, and the sixth radiation element are disposed on the bottom surface of the dielectric substrate.

In some embodiments, the antenna structure covers an operation frequency band from 5150 MHz to 5850 MHz.

In some embodiments, the combination of the first feeding element and the second feeding element substantially has an S-shape.

In some embodiments, the antenna structure further includes a first via element and a second via element. The first via element penetrates the dielectric substrate. The first feeding element is coupled through the first via element to the first radiation element. The second via element penetrates the dielectric substrate. The second feeding element is coupled through the second via element to the second radiation element.

In some embodiments, a first resonant path is formed from the feeding point through the first feeding element, the first via element and the first connection element to the central opening of the central ground element. A second resonant path is formed from the feeding point through the second feeding element, the second via element and the third connection element to the central opening of the central ground element. The length of each of the first resonant path and the second resonant path is an integral multiple of 0.25 wavelength of the operation frequency band.

In some embodiments, the antenna structure further includes a coaxial cable. The coaxial cable includes a central conductive line and a conductive housing. The central conductive line passes through the central opening and is coupled to the feeding point. The conductive housing is coupled to the central ground element.

In some embodiments, the central ground element substantially has a Z-shape.

In some embodiments, the first connection element includes a first U-shaped portion and a first straight portion which are coupled to each other. The third connection element includes a second U-shaped portion and a second straight portion which are coupled to each other.

In some embodiments, a loop structure is formed by the combination of the first radiation element, the second radiation element, the third radiation element, the fourth radiation element, the fifth radiation element, and the sixth radiation element.

In some embodiments, the balun structure is disposed inside a hollow portion of the loop structure.

In some embodiments, the loop structure substantially has a hollow square shape.

In some embodiments, the loop structure substantially has a hollow circular shape.

In some embodiments, the length or the width of the loop structure is from 0.1 to 0.5 wavelength of the operation frequency band.

In some embodiments, each of the first coupling gap, the second coupling gap, the third coupling gap, and the fourth coupling gap substantially has an N-shape.

In some embodiments, each of the first coupling gap, the second coupling gap, the third coupling gap, and the fourth coupling gap substantially has a V-shape.

In some embodiments, the length of each of the first coupling gap, the second coupling gap, the third coupling gap, and the fourth coupling gap is from 0 to 0.25 wavelength of the operation frequency band.

In some embodiments, the width of each of the first coupling gap, the second coupling gap, the third coupling gap, and the fourth coupling gap is from 0.1 mm to 2 mm.

In some embodiments, a fifth coupling gap is formed between the second connection element and the third radiation element, and a sixth coupling gap is formed between the fourth connection element and the fourth radiation element.

In some embodiments, the second connection element further includes a first terminal bending portion disposed adjacent to the fifth coupling gap. The fourth connection element further includes a second terminal bending portion disposed adjacent to the sixth coupling gap.

In some embodiments, the width of each of the fifth coupling gap and the sixth coupling gap is from 0.1 mm to 0.3 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
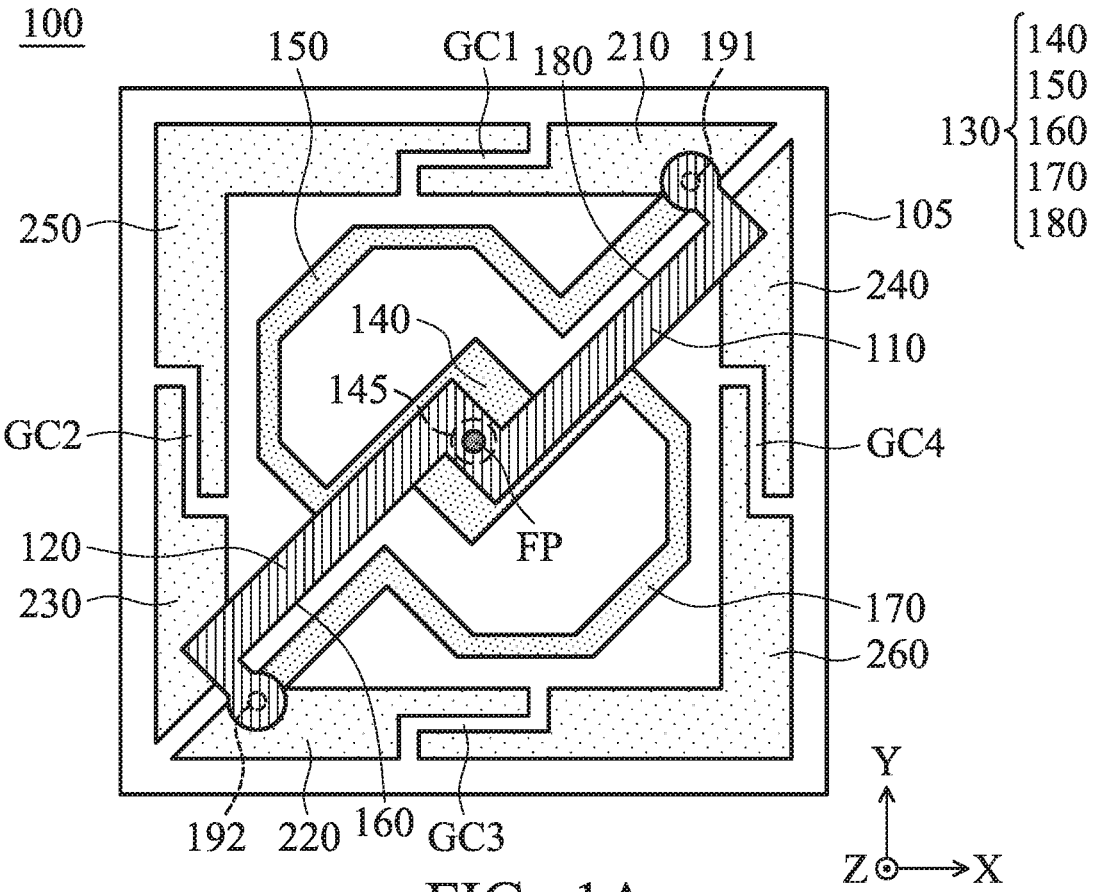
FIG. 1A is a view of a complete antenna structure according to an embodiment of the invention.
Figure 1B:
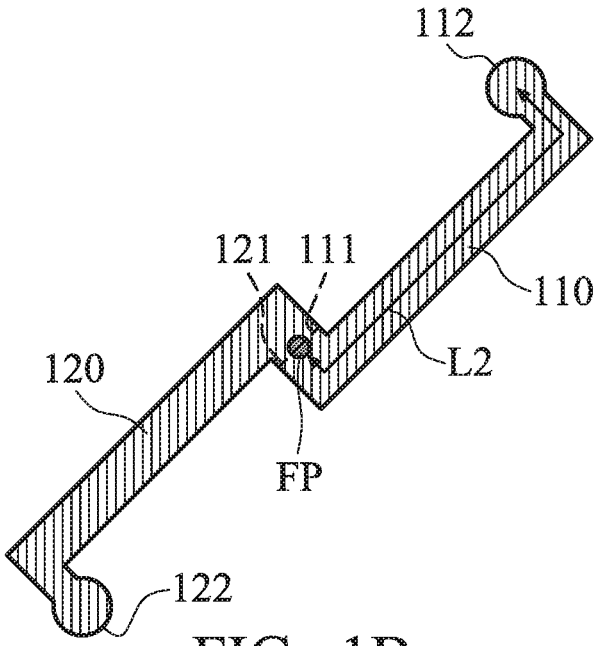
FIG. 1B is a view of an upper layer of an antenna structure according to an embodiment of the invention.
Figure 1C:
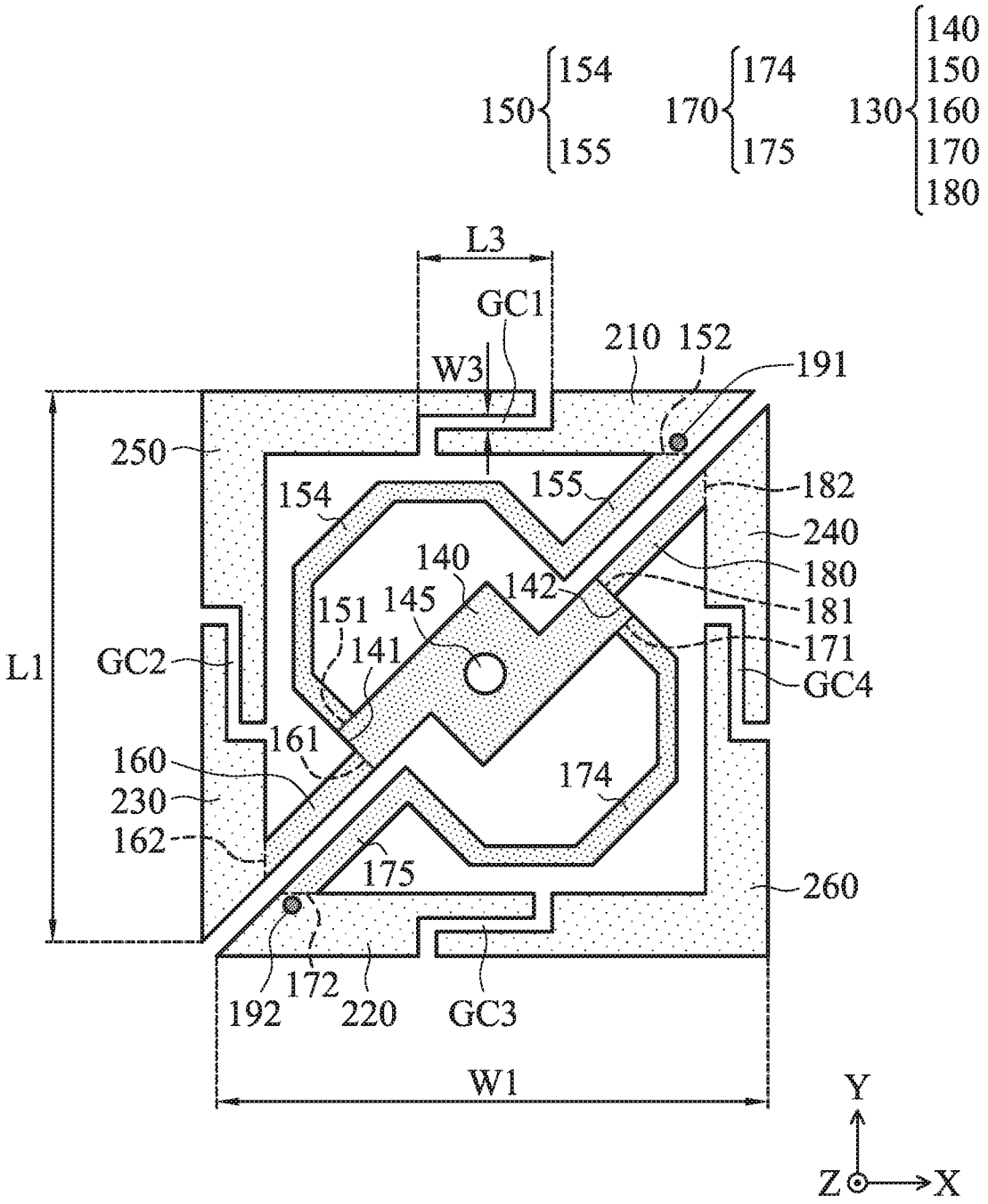
FIG. 1C is a view of a lower layer of an antenna structure according to an embodiment of the invention.

FIG. 1A is a view of a complete antenna structure 100 according to an embodiment of the invention. The antenna structure 100 includes a dielectric substrate 105. The dielectric substrate 105 has a top surface and a bottom surface which are opposite to each other. The dielectric substrate 105 may be a PCB (Printed Circuit Board), an FR4 (Flame Retardant 4) substrate, or an FCB (Flexible Circuit Board). FIG. 1B is a view of an upper layer of the antenna structure 100 according to an embodiment of the invention, that is, a partial antenna pattern disposed on the top surface of the dielectric substrate 105 is displayed. FIG. 1C is a view of a lower layer of the antenna structure 100 according to an embodiment of the invention, that is, another partial antenna pattern disposed on the bottom surface of the dielectric substrate 105 is displayed. FIG. 1A is a combination of FIG. 1B and FIG. 1C. It should be noted that FIG. 1B is a top view of FIG. 1A, but FIG. 1C is a see-through view of the lower layer of the antenna pattern, instead of the back view of FIG. 1C (the difference between the see-through view and the back view is a 180-degree flip therebetween). Please refer to FIG. 1A, FIG. 1B, and FIG. 1C together. The antenna structure 100 may be applied to a wireless access point. In the embodiment of FIG. 1A, FIG. 1B, and FIG. 1C, besides the dielectric substrate 105, the antenna structure 100 further includes a first feeding element 110, a second feeding element 120, a balun structure 130, a first radiation element 210, a second radiation element 220, a third radiation element 230, a fourth radiation element 240, a fifth radiation element 250, and a sixth radiation element 260. The balun structure 130 includes a central ground element 140, a first connection element 150, a second connection element 160, a third connection element 170, and a fourth connection element 180. All of the above elements may be made of metal materials, such as copper, silver, aluminum, iron, or their alloys. The first feeding element 110 and the second feeding element 120 may both be disposed on the top surface of the dielectric substrate 105. The balun structure 130, the first radiation element 210, the second radiation element 220, the third radiation element 230, the fourth radiation element 240, the fifth radiation element 250, and the sixth radiation element 260 may all be disposed on the bottom surface of the dielectric substrate 105.

The antenna structure 100 has a feeding point FP, which may be coupled to a signal source, such as an RF (Radio Frequency) module (not shown). The RF module is configured to excite the antenna structure 100. Each of the first feeding element 110 and the second feeding element 120 may substantially have a U-shape or a straight-line shape. The combination of the first feeding element 110 and the second feeding element 120 may substantially have an S-shape. For example, the feeding point FP may be positioned at the central point of the aforementioned S-shape. Specifically, the first feeding element 110 has a first end 111 and a second end 112, and the first end 111 of the first feeding element 110 is coupled to the feeding point FP; the second feeding element 120 has a first end 121 and a second end 122, and the first end 121 of the second feeding element 120 is coupled to the feeding point FP. In some embodiments, the antenna structure 100 further includes a first via element 191 and a second via element 192 which are made of metal materials. Both the first via element 191 and the second via element 192 penetrate the dielectric substrate 105. The second end 112 of the first feeding element 110 may be coupled through the first via element 191 to the first radiation element 210. The second end 122 of the second feeding element 120 may be coupled through the second via element 192 to the second radiation element 220.

The central ground element 140 may substantially have a Z-shape. A central opening 145 is formed on the central ground element 140. The central opening 145 may substantially have a circular shape, a square shape, or a triangular shape, but it is not limited thereto. The central ground element 140 has a first end 141 and a second end 142 which are far away from each other. The central ground element 140 is at least partially surrounded by the first connection element 150. The first connection element 150 has a first end 151 and a second end 152. The first end 151 of the first connection element 150 is coupled to the first end 141 of the central ground element 140. In some embodiments, the first connection element 150 includes a first U-shaped portion 154 (adjacent to the first end 151) and a first straight portion 155 (adjacent to the second end 152) which are coupled to each other. An open side of the first U-shaped portion 154 is arranged toward the central ground element 140. The second connection element 160 may substantially have a straight-line shape. The second connection element 160 has a first end 161 and a second end 162. The first end 161 of the second connection element 160 is coupled to the first end 141 of the central ground element 140. The second end 162 of the second connection element 160 and the second end 152 of the first connection element 150 substantially extend in opposite directions. The central ground element 140 is at least partially surrounded by the third connection element 170. The third connection element 170 has a first end 171 and a second end 172. The first end 171 of the third connection element 170 is coupled to the second end 142 of the central ground element 140. In some embodiments, the third connection element 170 includes a second U-shaped portion 174 (adjacent to the first end 171) and a second straight portion 175 (adjacent to the second end 172) which are coupled to each other. An open side of the second U-shaped portion 174 is arranged toward the central ground element 140. The fourth connection element 180 may substantially have a straight-line shape. The fourth connection element 180 has a first end 181 and a second end 182. The first end 181 of the fourth connection element 180 is coupled to the second end 142 of the central ground element 140. The second end 182 of the fourth connection element 180 and the second end 172 of the third connection element 170 substantially extend in opposite directions. It should be noted that the term "adjacent" or "close" over the disclosure means that the distance (spacing) between two corresponding elements is smaller than a predetermined distance (e.g., 5 mm or the shorter), or means that the two corresponding elements directly touch each other (i.e., the aforementioned distance/spacing therebetween is reduced to 0).

The first radiation element 210 is coupled to the second end 152 of the first connection element 150. The first radiation element 210 is directly fed by the first feeding element 110 using the first via element 191. The first via element 191 may be substantially positioned at the junction between the first radiation element 210 and the second end 152 of the first connection element 150. The second radiation element 220 is coupled to the second end 172 of the third connection element 170. The second radiation element 220 is directly fed by the second feeding element 120 using the second via element 192. The second via element 192 may be substantially positioned at the junction between the second radiation element 220 and the second end 172 of the third connection element 170. The third radiation element 230 is directly coupled to the second end 162 of the second connection element 160. The fourth radiation element 240 is directly coupled to the second end 182 of the fourth connection element 180. Specifically, each of the first radiation element 210, the second radiation element 220, the third radiation element 230, and the fourth radiation element 240 may have a variable-width structure which includes a narrow portion and a wide portion, and the narrow portion is coupled through the wide portion to a corresponding connection element. The fifth radiation element 250 is floating and adjacent to the first radiation element 210 and the third radiation element 230. A first coupling gap GC1 is formed between the fifth radiation element 250 and the first radiation element 210. A second coupling gap GC2 is formed between the fifth radiation element 250 and the third radiation element 230. The sixth radiation element 260 is floating and adjacent to the second radiation element 220 and the fourth radiation element 240. A third coupling gap GC3 is formed between the sixth radiation element 260 and the second radiation element 220. A fourth coupling gap GC4 is formed between the sixth radiation element 260 and the fourth radiation element 240. For example, each of the first coupling gap GC1, the second coupling gap GC2, the third coupling gap GC3, and the fourth coupling gap GC4 may substantially have an N-shape. A loop structure is formed by the combination of the first radiation element 210, the second radiation element 220, the third radiation element 230, the fourth radiation element 240, the fifth radiation element 250, and the sixth radiation element 260. The aforementioned balun structure 130 is disposed inside a hollow portion of the loop structure. For example, the loop structure may substantially have a hollow square shape. It should be noted that the shapes and styles of the first radiation element 210, the second radiation element 220, the third radiation element 230, the fourth radiation element 240, the fifth radiation element 250, the sixth radiation element 260, the first coupling gap GC1, the second coupling gap GC2, the third coupling gap GC3, and the fourth coupling gap GC4 are adjustable according to different requirements. In some embodiments, the antenna structure 100 is a point-symmetric pattern with respect to its central feeding point FP.

In some embodiments, the antenna structure 100 covers an operation frequency band from 5150 MHz to 5850 MHz.

Accordingly, the antenna structure 100 can at least cover the wideband operation of WLAN (Wireless Local Area Networks) 5 GHz. However, the invention is not limited thereto. In alternative embodiments, the operation frequency band of the antenna structure 100 is adjustable according to different requirements.

Figure 2:
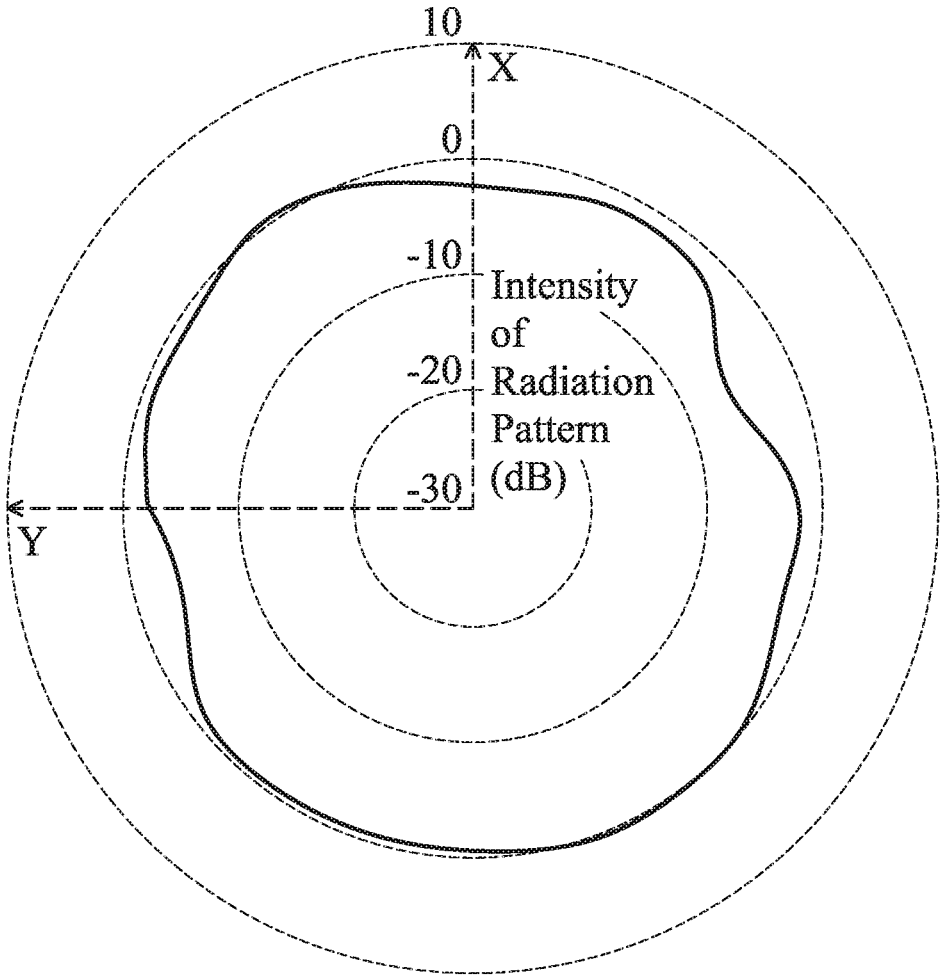
FIG. 2 is a radiation pattern of an antenna structure within an operation frequency band according to an embodiment of the invention.

FIG. 2 is a radiation pattern of the antenna structure 100 within the operation frequency band according to an embodiment of the invention, which is measured along the XY plane. According to the measurement of FIG. 2, the antenna structure 100 can generate an almost omnidirectional horizontally-polarized radiation pattern, which meets the requirements for practical application.

Figure 3:
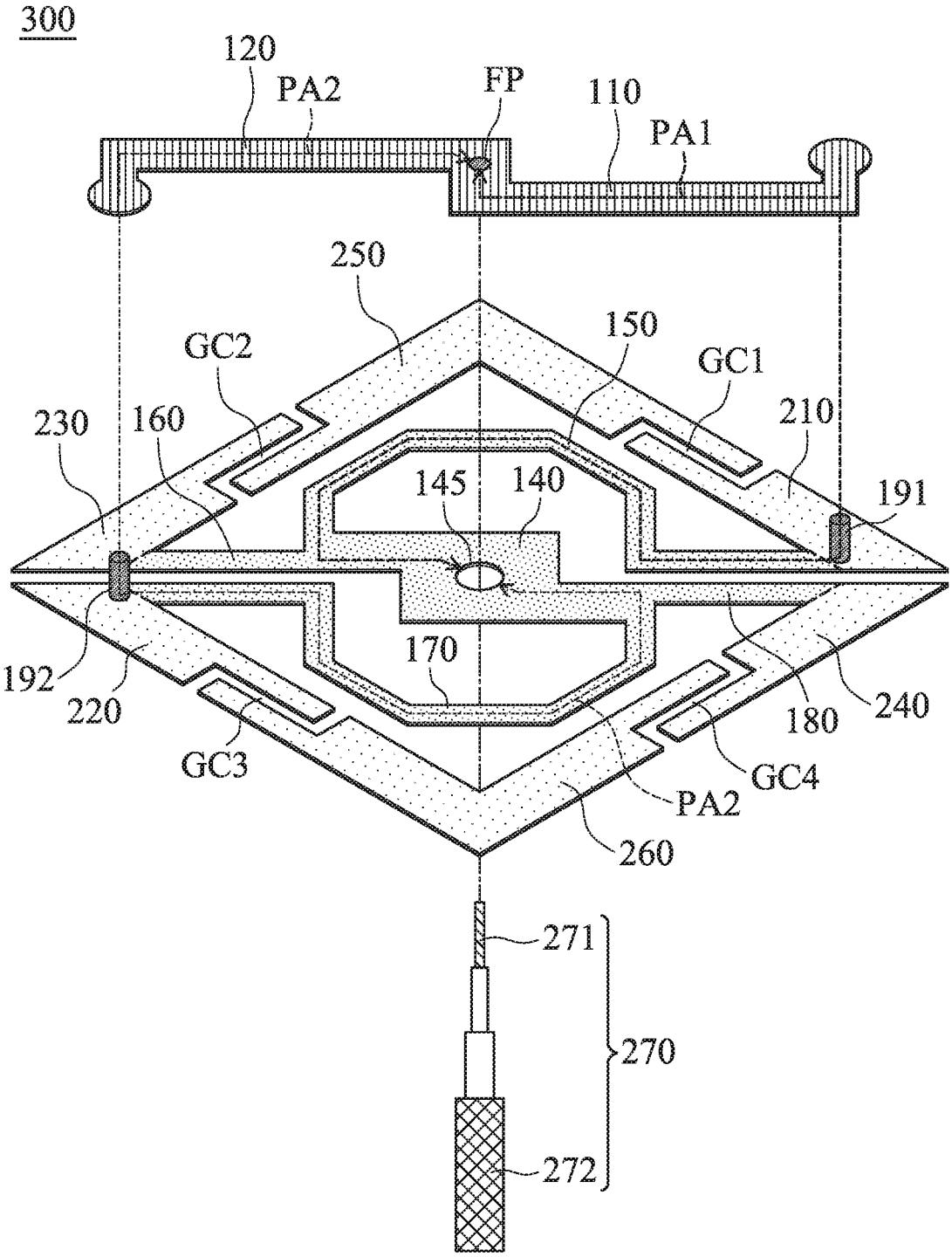
FIG. 3 is a exploded view of an antenna structure according to an embodiment of the invention.

FIG. 3 is an exploded view of an antenna structure 300 according to an embodiment of the invention. FIG. 3 is similar to FIG. 1A, FIG. 1B and FIG. 1C. In the embodiment of FIG. 3, the antenna structure 300 further includes a coaxial cable 270. The coaxial cable 270 includes a central conductive line 271 and a conductive housing 272. A positive electrode of a signal source is coupled to the central conductive line 271, and a negative electrode of the signal source is coupled to the conductive housing 272, so as to excite the antenna structure 300. Specifically, the central conductive line 271 passes through the central opening 145 and is coupled to the feeding point FP, and the conductive housing 272 is coupled to the central ground element 140. According to practical measurements, the balun structure 130 can attract vertical currents on the conductive housing 272, so as to suppress a vertically-polarized radiation pattern of the antenna structure 300.

In the proposed design, the total size of the antenna structure 100 (or 300) is effectively minimized by appropriately bending each radiation element of the antenna structure 100 (or 300). According to practical measurements, the incorporation of the balun structure 130 can suppress the unwanted vertically-polarized radiation pattern, thereby increasing the whole antenna radiation gain. The total area of the antenna structure 100 (or 300) of the invention is 75% smaller than that of a conventional Alford loop antenna, without negatively affecting the operation frequency band or radiation efficiency. Therefore, the antenna structure 100 (or 300) of the invention has the advantages of a small size, wide frequency band, omnidirectivity, and high antenna efficiency.

In some embodiments, the element sizes of the antenna structure 100 (or 300) are described as follows. A first resonant path PA1 is formed from the feeding point FP through the first feeding element 110, the first via element 191 and the first connection element 150 to the central opening 145 of the central ground element 140. In addition, a second resonant path PA2 is formed from the feeding point FP through the second feeding element 120, the second via element 192 and the third connection element 170 to the central opening 145 of the central ground element 140. The length of each of the first resonant path PA1 and the second resonant path PA2 may be substantially equal to an integral multiple of 0.25 wavelength (i.e., N*0.25λ, where N is a positive integer, such as 3) of the operation frequency band of the antenna structure 100 (or 300). The length L1 and/or the width W1 of the loop structure, which is formed by the first radiation element 210, the second radiation element 220, the third radiation element 230, the fourth radiation element 240, the fifth radiation element 250, and the sixth radiation element 260, may be from 0.1 to 0.5 wavelength (0.1λ~0.5λ) of the operation frequency band of the antenna structure 100 (or 300). The length L2 of each of the first feeding element 110 and the second feeding element 120 may be from 0.1 to 0.5 wavelength (0.1λ~0.5λ) of the operation frequency band of the antenna structure 100 (or 300). The length L3 of each of the first coupling gap GC1, the second coupling gap GC2, the third coupling gap GC3, and the fourth coupling gap GC4 may be from 0 to 0.25 wavelength (0~0.25λ) of the operation frequency band of the antenna structure 100 (or 300). The width W3 of each of the first coupling gap GC1, the second coupling gap GC2, the third coupling gap GC3, and the fourth coupling gap GC4 may be from 0.1 mm to 2 mm. The above ranges of element sizes are calculated and obtained according to many experiment results, and they help to optimize the operation bandwidth and impedance matching of the antenna structure 100 (or 300).

Figure 4A:
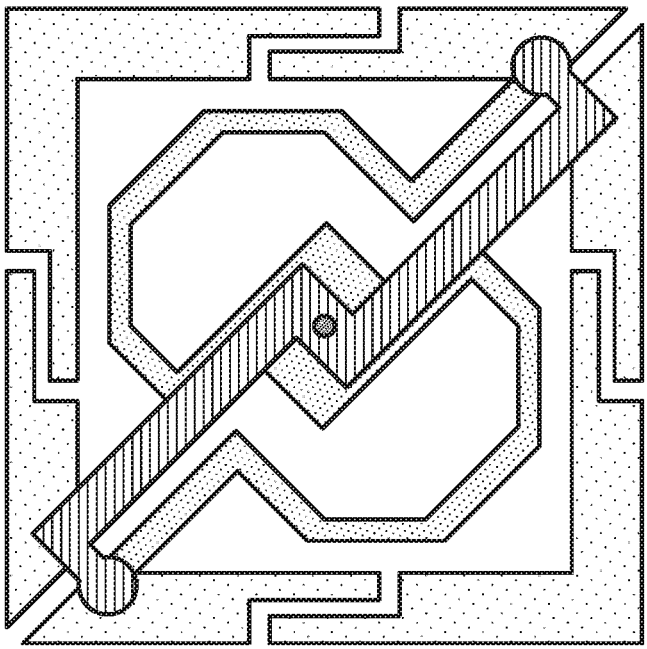
FIG. 4A is a view of a complete antenna structure according to an embodiment of the invention.
Figure 4B:
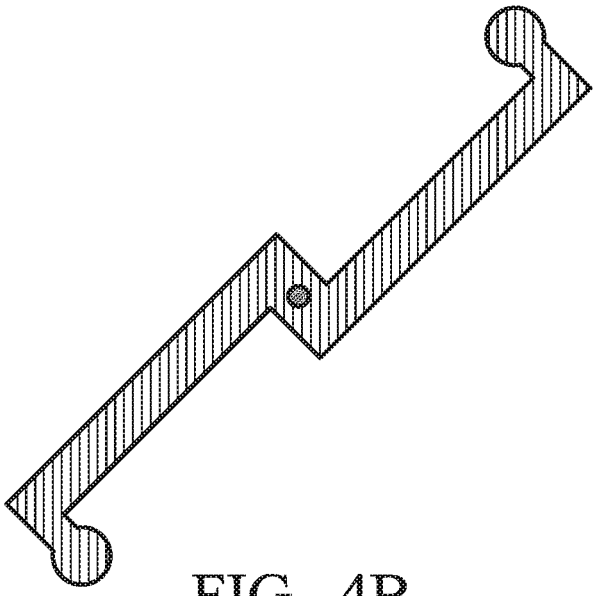
FIG. 4B is a view of an upper layer of an antenna structure according to an embodiment of the invention.
Figure 4C:
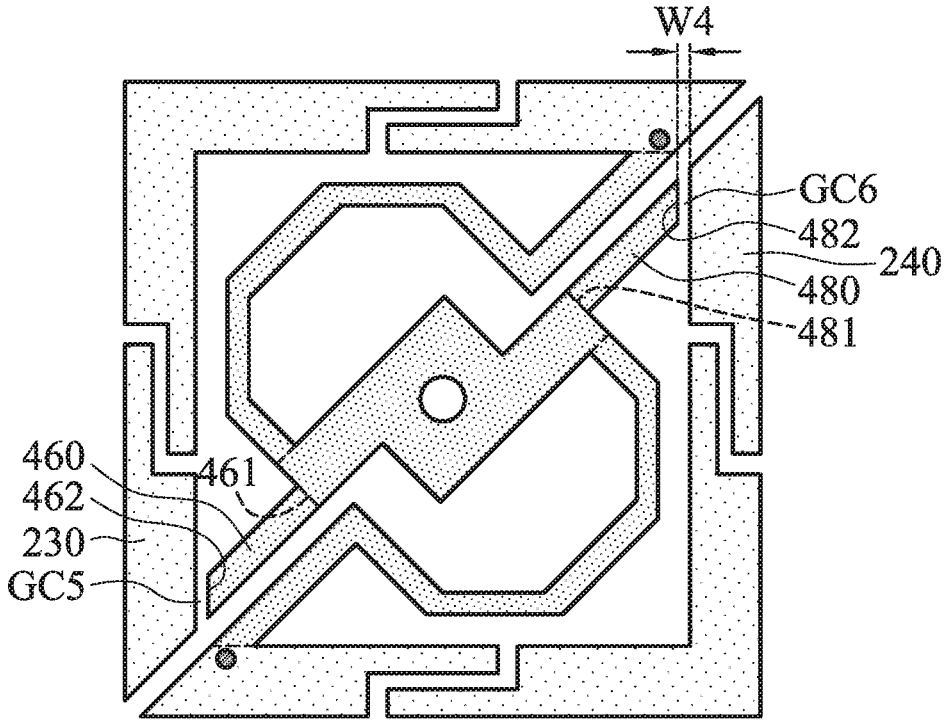
FIG. 4C is a view of a lower layer of an antenna structure according to an embodiment of the invention.

FIG. 4A is a view of a complete antenna structure 400 according to an embodiment of the invention. FIG. 4B is a view of an upper layer of the antenna structure 400 according to an embodiment of the invention. FIG. 4C is a view of a lower layer of the antenna structure 400 according to an embodiment of the invention. FIG. 4A, FIG. 4B and FIG. 4C are similar to FIG. 1A, FIG. 1B and FIG. 1C. In the embodiment of FIG. 4A, FIG. 4B and FIG. 4C, the antenna structure 400 includes a second connection element 460 and a fourth connection element 480, and they replace the original directly-feeding mechanism with a coupling-feeding mechanism. Specifically, the second connection element 460 has a first end 461 and a second end 462, and the second end 462 of the second connection element 460 is adjacent to the third radiation element 230 but is separate from the third radiation element 230; the fourth connection element 480 has a first end 481 and a second end 482, and the second end 482 of the fourth connection element 480 is adjacent to the fourth radiation element 240 but is separate from the fourth radiation element 240. A fifth coupling gap GC5 is formed between the second end 462 of the second connection element 460 and the third radiation element 230. A sixth coupling gap GC6 is formed between the second end 482 of the fourth connection element 480 and the fourth radiation element 240. For example, the width W4 of each of the fifth coupling gap GC5 and the sixth coupling gap GC6 may be from 0.1 mm to 0.3 mm, so as to enhance the coupling effects between elements. According to practical measurements, the radiation performance of the antenna structure 400 using the coupling-feeding mechanism is almost unchanged, in comparison to that of the antenna structure 100 using the directly-feeding mechanism. Other features of the antenna structure 400 of FIG. 4A, FIG. 4B and FIG. 4C are similar to those of the antenna structure 100 of FIG. 1A, FIG. 1B and FIG. 1C. Accordingly, the two embodiments can achieve similar levels of performance.

Figure 5A:
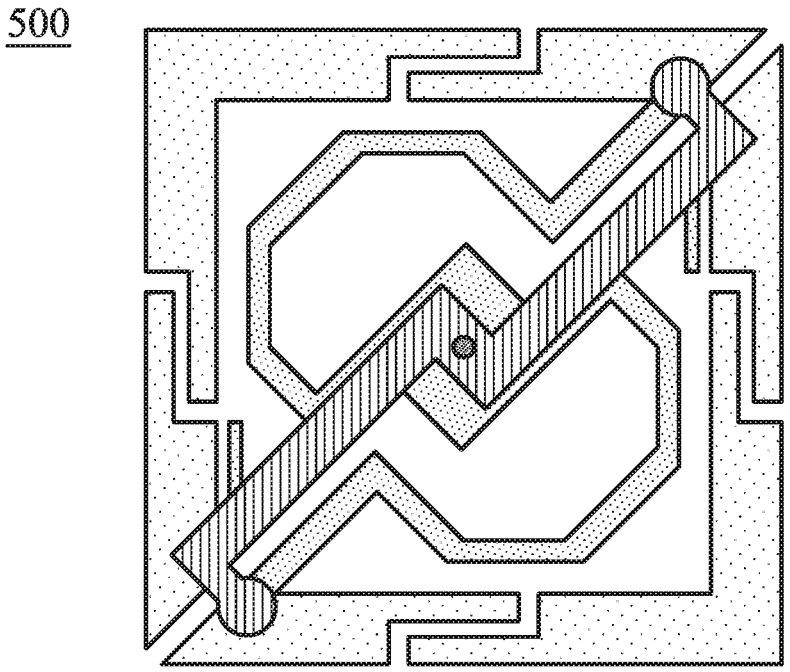
FIG. 5A is a view of a complete antenna structure according to an embodiment of the invention.
Figure 5B:
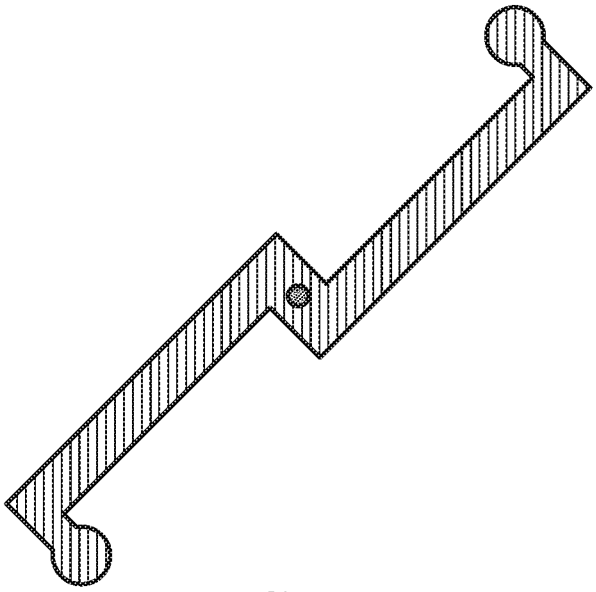
FIG. 5B is a view of an upper layer of an antenna structure according to an embodiment of the invention.
Figure 5C:
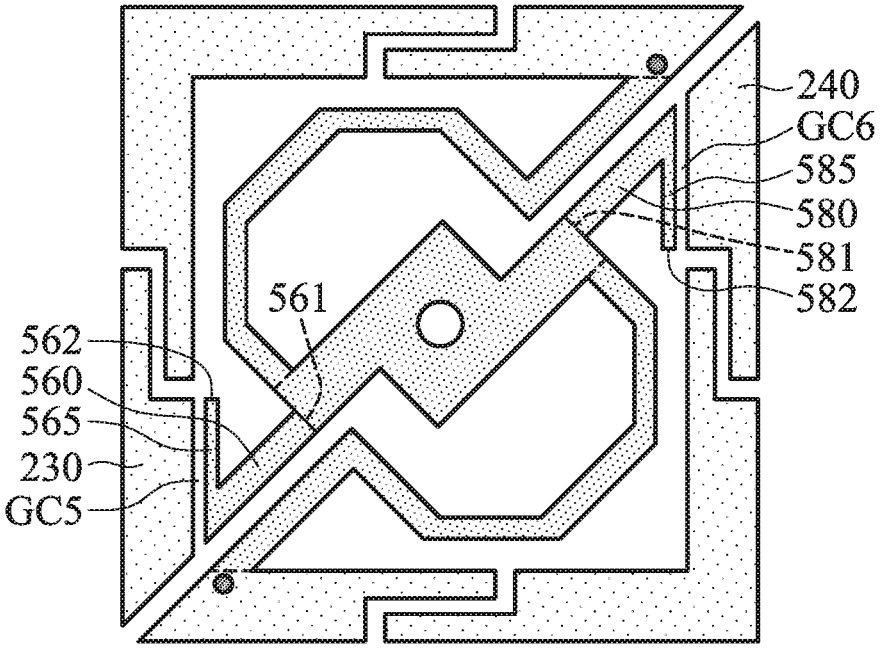
FIG. 5C is a view of a lower layer of an antenna structure according to an embodiment of the invention.

FIG. 5A is a view of a complete antenna structure 500 according to an embodiment of the invention. FIG. 5B is a view of an upper layer of the antenna structure 500 according to an embodiment of the invention. FIG. 5C is a view of a lower layer of the antenna structure 500 according to an embodiment of the invention. FIG. 5A, FIG. 5B and FIG. 5C are similar to FIG. 4A, FIG. 4B and FIG. 4C. In the embodiment of FIG. 5A, FIG. 5B and FIG. 5C, the antenna structure 500 includes a second connection element 560 and a fourth connection element 580, the second connection element 560 further includes a first terminal bending portion 565, and the fourth connection element 580 further includes a second terminal bending portion 585. Specifically, the second connection element 560 has a first end 561 and a second end 562, and the first terminal bending portion 565 is positioned at the second end 562 of the second connection element 560 and is adjacent to the fifth coupling gap GC5 and the third radiation element 230; the fourth connection element 580 has a first end 581 and a second end 582, and the second terminal bending portion 585 is positioned at the second end 582 of the fourth connection element 580 and is adjacent to the sixth coupling gap GC6 and the fourth radiation element 240. According to practical measurements, the incorporation of the first terminal bending portion 565 and the second terminal bending portion 585 can further enhance the coupling effects relative to the fifth coupling gap GC5 and the sixth coupling gap GC6, thereby increasing the radiation efficiency of the antenna structure 500. Other features of the antenna structure 500 of FIG. 5A, FIG. 5B and FIG. 5C are similar to those of the antenna structure 400 of FIG. 4A, FIG. 4B and FIG. 4C. Accordingly, the two embodiments can achieve similar levels of performance.

Figure 6A:
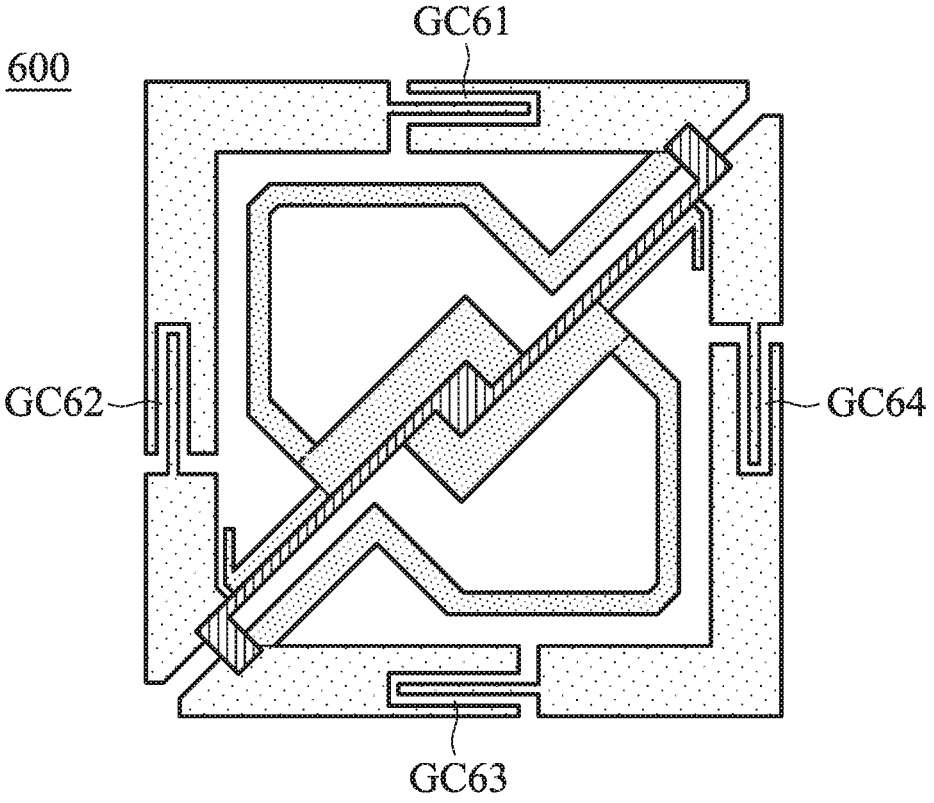
FIG. 6A is a view of a complete antenna structure according to an embodiment of the invention.
Figure 6B:
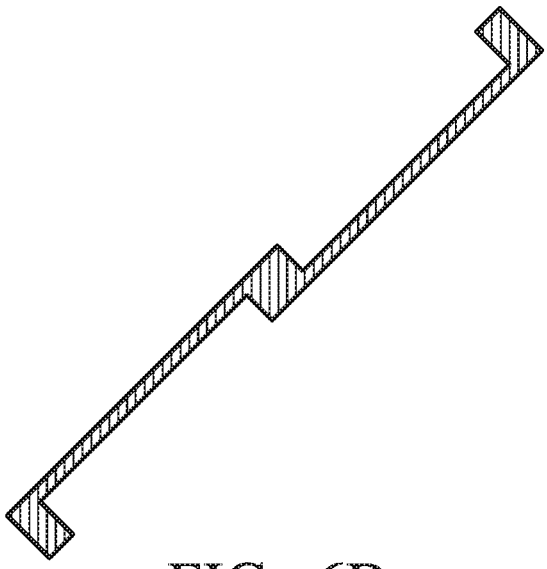
FIG. 6B is a view of an upper layer of an antenna structure according to an embodiment of the invention.
Figure 6C:
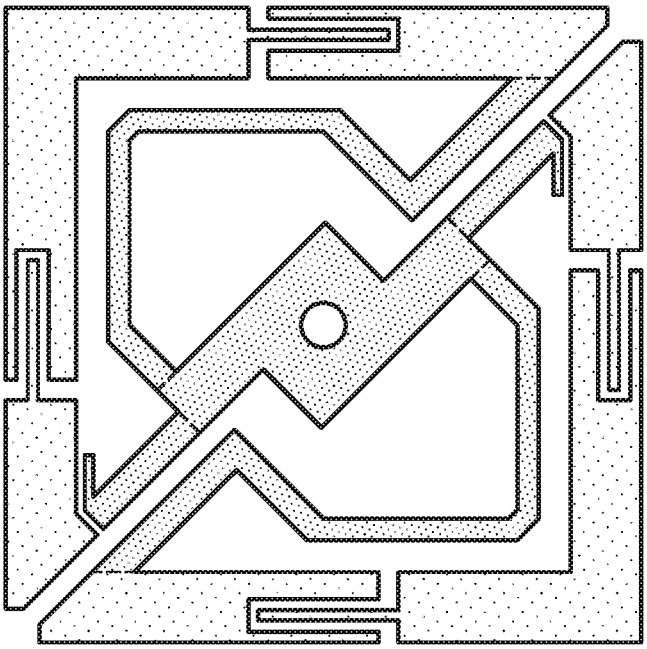
FIG. 6C is a view of a lower layer of an antenna structure according to an embodiment of the invention.

FIG. 6A is a view of a complete antenna structure 600 according to an embodiment of the invention. FIG. 6B is a view of an upper layer of the antenna structure 600 according to an embodiment of the invention. FIG. 6C is a view of a lower layer of the antenna structure 600 according to an embodiment of the invention. FIG. 6A, FIG. 6B and FIG. 6C are similar to FIG. 1A, FIG. 1B and FIG. 1C. In the embodiment of FIG. 6A, FIG. 6B and FIG. 6C, the antenna structure 600 has a first coupling gap GC61, a second coupling gap GC62, a third coupling gap GC63, and a fourth coupling gap GC64, which have different shapes. For example, each of the first coupling gap GC61, the second coupling gap GC62, the third coupling gap GC63, and the fourth coupling gap GC64 may substantially has a V-shape or a U-shape. According to practical measurements, such a design can further enhance the coupling effects relative to the first coupling gap GC61, the second coupling gap GC62, the third coupling gap GC63, and the fourth coupling gap GC64, thereby increasing the radiation efficiency of the antenna structure 600. Other features of the antenna structure 600 of FIG. 6A, FIG. 6B and FIG. 6C are similar to those of the antenna structure 100 of FIG. 1A, FIG. 1B and FIG. 1C. Accordingly, the two embodiments can achieve similar levels of performance.

Figure 7A:
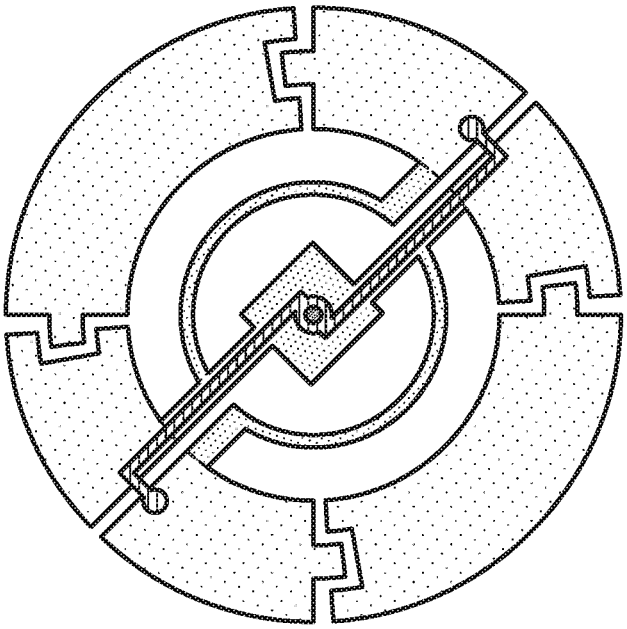
FIG. 7A is a view of a complete antenna structure according to an embodiment of the invention.
Figure 7B:
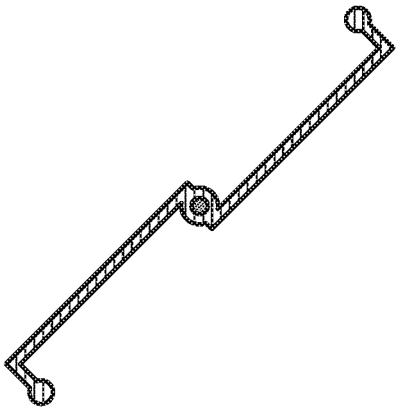
FIG. 7B is a view of an upper layer of an antenna structure according to an embodiment of the invention.
Figure 7C:
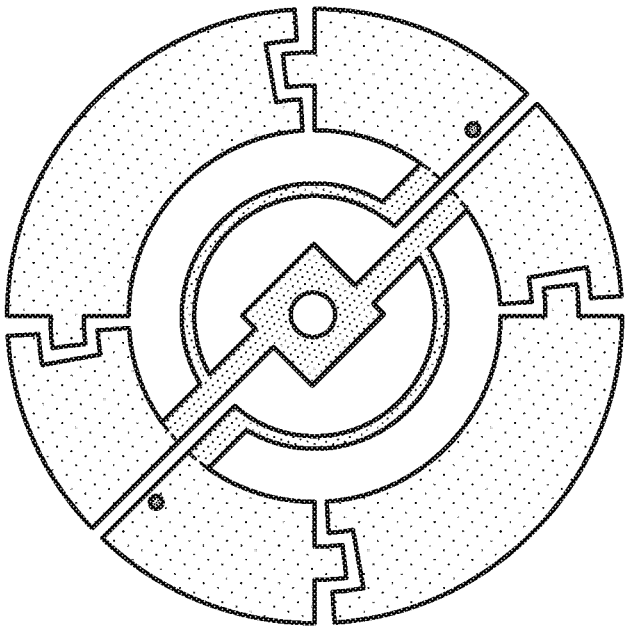
FIG. 7C is a view of a lower layer of an antenna structure according to an embodiment of the invention.

FIG. 7A is a view of a complete antenna structure 700 according to an embodiment of the invention. FIG. 7B is a view of an upper layer of the antenna structure 700 according to an embodiment of the invention. FIG. 7C is a view of a lower layer of the antenna structure 700 according to an embodiment of the invention. FIG. 7A, FIG. 7B and FIG. 7C are similar to FIG. 1A, FIG. 1B and FIG. 1C. In the embodiment of FIG. 7A, FIG. 7B and FIG. 7C, adjustments are made such that the antenna structure 700 substantially has a circular shape, and the aforementioned loop structure substantially has a hollow circular shape. According to practical measurements, such a design does not negatively affect the radiation performance of the invention. In alternative embodiments, the antenna structure 700 has other shapes, such as an elliptical shape, a triangular shape, a hexagonal shape, or an octagonal shape, but it is not limited thereto. Other features of the antenna structure 700 of FIG. 7A, FIG. 7B and FIG. 7C are similar to those of the antenna structure 100 of FIG. 1A, FIG. 1B and FIG. 1C. Accordingly, the two embodiments can achieve similar levels of performance.

The invention proposes a novel antenna structure. In comparison to the conventional design, the invention has at least the advantages of: (1) covering a wider frequency band, (2) providing an almost omnidirectional radiation pattern, (3) effectively reducing the total antenna size, (4) increasing the antenna radiation efficiency, (5) having a simple structure to be easily manufactured, and (6) reducing the total manufacturing cost. Therefore, the invention is suitable for application in a variety of multiband communication devices or wireless access points.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-7. The invention may merely include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a first feeding element, coupled to a feeding point;

a second feeding element, coupled to the feeding point;

a balun structure, comprising:

a central ground element, having a central opening;

a first connection element, coupled to the central ground element, wherein the central ground element is at least partially surrounded by the first connection element;

a second connection element, coupled to the central ground element;

a third connection element, coupled to the central ground element, wherein the central ground element is at least partially surrounded by the third connection element; and a fourth connection element, coupled to the central ground element;

a first radiation element, coupled to the first connection element, wherein the first radiation element is fed by the first feeding element;

a second radiation element, coupled to the third connection element, wherein the second radiation element is fed by the second feeding element;

a third radiation element, disposed adjacent to or coupled to the second connection element;

a fourth radiation element, disposed adjacent to or coupled to the fourth connection element;

a fifth radiation element, wherein a first coupling gap is formed between the fifth radiation element and the first radiation element, and a second coupling gap is formed between the fifth radiation element and the third radiation element;

a sixth radiation element, wherein a third coupling gap is formed between the sixth radiation element and the second radiation element, and a fourth coupling gap is formed between the sixth radiation element and the fourth radiation element; and a dielectric substrate, having a top surface and a bottom surface;

wherein the first feeding element and the second feeding element are disposed on the top surface of the dielectric substrate;

wherein the balun structure, the first radiation element, the second radiation element, the third radiation element, the fourth radiation element, the fifth radiation element, and the sixth radiation element are disposed on the bottom surface of the dielectric substrate.

2. The antenna structure as claimed in claim 1, wherein the antenna structure covers an operation frequency band from 5150 MHz to 5850 MHz.

3. The antenna structure as claimed in claim 1, wherein a combination of the first feeding element and the second feeding element substantially has an S-shape.

4. The antenna structure as claimed in claim 2, further comprising:

a first via element, penetrating the dielectric substrate, wherein the first feeding element is coupled through the first via element to the first radiation element; and a second via element, penetrating the dielectric substrate, wherein the second feeding element is coupled through the second via element to the second radiation element.

5. The antenna structure as claimed in claim 4, wherein a first resonant path is formed from the feeding point through the first feeding element, the first via element and the first connection element to the central opening of the central ground element, wherein a second resonant path is formed from the feeding point through the second feeding element, the second via element and the third connection element to the central opening of the central ground element, and wherein a length of each of the first resonant path and the second resonant path is an integral multiple of 0.25 wavelength of the operation frequency band.

6. The antenna structure as claimed in claim 1, further comprising:

a coaxial cable, comprising a central conductive line and a conductive housing, wherein the central conductive line passes through the central opening and is coupled to the feeding point, and the conductive housing is coupled to the central ground element.

7. The antenna structure as claimed in claim 1, wherein the central ground element substantially has a Z-shape.

8. The antenna structure as claimed in claim 1, wherein the first connection element comprises a first U-shaped portion and a first straight portion coupled to each other, and wherein the third connection element comprises a second U-shaped portion and a second straight portion coupled to each other.

9. The antenna structure as claimed in claim 2, wherein a loop structure is formed by a combination of the first radiation element, the second radiation element, the third radiation element, the fourth radiation element, the fifth radiation element, and the sixth radiation element.

10. The antenna structure as claimed in claim 9, wherein the balun structure is disposed inside a hollow portion of the loop structure.

11. The antenna structure as claimed in claim 9, wherein the loop structure substantially has a hollow square shape.

12. The antenna structure as claimed in claim 9, wherein the loop structure substantially has a hollow circular shape.

13. The antenna structure as claimed in claim 9, wherein a length or a width of the loop structure is from 0.1 to 0.5 wavelength of the operation frequency band.

14. The antenna structure as claimed in claim 1, wherein each of the first coupling gap, the second coupling gap, the third coupling gap, and the fourth coupling gap substantially has an N-shape.

15. The antenna structure as claimed in claim 1, wherein each of the first coupling gap, the second coupling gap, the third coupling gap, and the fourth coupling gap substantially has a V-shape.

16. The antenna structure as claimed in claim 2, wherein a length of each of the first coupling gap, the second coupling gap, the third coupling gap, and the fourth coupling gap is from 0 to 0.25 wavelength of the operation frequency band.

17. The antenna structure as claimed in claim 1, wherein a width of each of the first coupling gap, the second coupling gap, the third coupling gap, and the fourth coupling gap is from 0.1 mm to 2 mm.

18. The antenna structure as claimed in claim 1, wherein a fifth coupling gap is formed between the second connection element and the third radiation element, and a sixth coupling gap is formed between the fourth connection element and the fourth radiation element.

19. The antenna structure as claimed in claim 18, wherein the second connection element further comprises a first terminal bending portion disposed adjacent to the fifth coupling gap, and wherein the fourth connection element further comprises a second terminal bending portion disposed adjacent to the sixth coupling gap.

20. The antenna structure as claimed in claim 18, wherein a width of each of the fifth coupling gap and the sixth coupling gap is from 0.1 mm to 0.3 mm.

* * * * *